United States Patent [19]

Gibson

[11] Patent Number: 4,488,801

[45] Date of Patent: Dec. 18, 1984

[54] MAXIMUM THROUGHPUT DUPLEXING SYSTEM FOR XEROGRAPHIC MACHINES

[75] Inventor: David K. Gibson, Boulder, Colo.

[73] Assignee: International Business Machines Corporation, Armonk, N.Y.

[21] Appl. No.: 455,368

[22] Filed: Jan. 3, 1983

[51] Int. Cl.[3] ..... G03G 15/00

[52] U.S. Cl. ..... 355/3 SH; 355/14 SH; 355/24

[58] Field of Search ..... 355/3 SH, 14 SH, 23, 355/24, 25, 26; 271/DIG. 9, 3.1, 4, 65, 186, 171, 95

[56] References Cited

U.S. PATENT DOCUMENTS

| | | | |
|---|---|---|---|
| 4,078,787 | 3/1978 | Burlew et al. | 271/3.1 |
| 4,132,398 | 1/1979 | Erdmann et al. | 271/95 X |
| 4,166,614 | 9/1979 | Hamlin et al. | 271/3.1 |
| 4,234,180 | 11/1980 | Looney | 271/3.1 |
| 4,253,759 | 3/1981 | Rattin | 355/3 SH X |
| 4,272,181 | 6/1981 | Treseder | 355/14 |
| 4,313,673 | 2/1982 | Wartinger et al. | 355/14 SH X |
| 4,355,880 | 10/1982 | Stemmie | 355/3 SH |

*Primary Examiner*—A. C. Prescott

*Attorney, Agent, or Firm*—Earl C. Hancock

[57] ABSTRACT

First side copying is produced on a sequence of copy sheets equivalent to the number required to fill a closed-loop duplex path that returns the sheets to the imaging station. An identical number of second images are transferred to the opposite sides as they are reintroduced from the closed-loop duplex path through the imaging station. The sheet reintroduction is timed so that the next image transfer cycle is used for the first reintroduced sheet. The copy sheets are passed through a fuser station either prior to exit from the machine or as an element of the closed-loop duplex return path.

6 Claims, 6 Drawing Figures

MAXIMUM THROUGHPUT DUPLEXING SYSTEM FOR XEROGRAPHIC MACHINES

BACKGROUND OF THE INVENTION

1. Field of the Invention

The present invention relates to xerographic or electrophotographic machines and processes for producing duplexed copies. More particularly, the present invention relates to electrophotographic printers and copiers which sequentially transfer images to opposite sides of copy sheets. This invention is especially useful in xerographic printers and is described herein within that context. However, the invention is likewise adaptable for use in conjunction with xerographic copiers.

2. Description of the Prior Art

Electrophotographic machines operating in a duplex mode wherein sequential images are transferred to opposite sides of a copy sheet, typically place the first image on the copy sheet and proceed with reversal of the copy sheet before reintroducing it to the image transfer station. An intervening tray or the like provides temporary storage and side reversal of the original copies. Frequently, the duplex tray holds only a single copy sheet but it is possible to accumulate a multiplicity of copy sheets where a multiplicity of copies are made of each image. In addition, it is possible to store multiple copies of sheets having sequential images on one side with feeding of those sheets to the imaging station provided the second side image is presented in proper order. Thus, prior art copiers and printers employ an essentially closed loop return path for the copy sheets intended to receive duplex copying. A logical decision is rendered as the copy sheet leaves the transfer and fusing paths to determine whether that sheet should enter the return loop or exit to a tray, collator, stapler/finisher, or the like. An example of an electrophotographic printer using a closed loop duplex copy sheet path is shown in commonly-assigned U.S. Pat. No. 4,272,181 filed Dec. 29, 1978 by R. C. Treseder.

Automatic duplex copying with use of return loop duplex paths is predominantly useful in electrophotographic machines having relatively high speed and high volume throughput. Accordingly, any delay in completing the copy sequences discounts the throughput speed of the machine. Unfortunately, the prior art electrophotographic machines are not arranged and operated so as to utilize every available transfer cycle associated with a given run. As a result, the throughput of the machine is necessarily reduced. The present invention resolves this problem by effectively arranging and utilizing the electrophotographic machine elements so as to use all available transfer cycles.

DISCLOSURE OF THE INVENTION

This invention is concerned with xerographic devices that have a station for transferring images to copy sheets sequentially fed from an input supply source, and wherein a closed loop copy sheet paper path is included for returning those copy sheets to the image transferring station with the opposite side presented for imaging. The xerographic device is operable to perform regularly spaced image transfer cycles at the image transfer station. In this environment, the invention includes feeding M out of N copy sheets sequentially from the source past the imaging transferring station and into the closed loop path, where N is a whole number corresponding to the maximum number of copy sheets containable within the closed-loop path and M is a whole number equal to or less than N. A first sequence of M images are transferred to the first side of the respective copy sheets thus fed. The M out of N copy sheets are then sequentially reintroduced to the image transferring station from the closed-loop path so that the first sheet thus reintroduced arrives at the image transfer station concurrent with the commencement of the next image transfer cycle after the Nth such cycle. A second sequence of M images are then transferred to the opposite side of respective such copy sheets as a consequence of the reintroduction.

To accommodate proper sequence of the copy sheets when delivered to an exit tray which has no means for compensating for the proper side presentation of the sheets, the second side images are transferred to the copy sheets during the first sequence transferring operation, while the first side images are transferred during the second sequence transferring. The copy sheets are then delivered to the exit tray following the second sequence transferal so that the resulting stack is in usable order.

The images on the copy sheet are fusable after the copy sheet leaves the transferring station which ensures that subsequent duplex handling will not degrade the image transfer quality. The particular output receptacle associated with the machine is accommodated by delivering the copy sheets to the output receptacle after the second sequence transferal and the image presentation during the first and second transferring operations are arranged to allow production of a properly ordered copy sheet set at the output receptacle.

Those having normal skill in the art will readily recognize the foregoing and other objects, features, advantages, and applications of the present invention in the light of the following more detailed description of the exemplary preferred embodiment as illustrated in the accompanying drawings.

DETAILED DESCRIPTION OF THE PREFERRED EMBODIMENT

Figure 1:
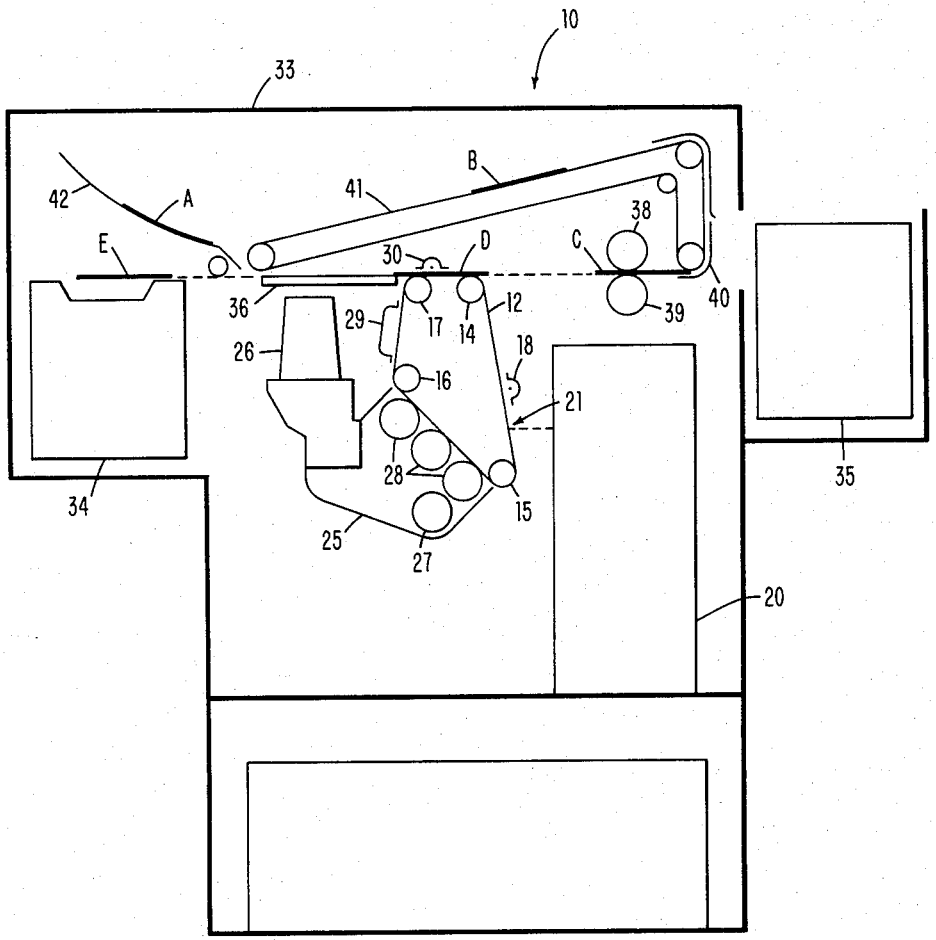
FIG. 1 is a somewhat schematic view of an electrophotographic printer including a paper return feed path to accommodate operation in accordance with the present invention.

FIG. 1 illustrates an electrophotographic printer 10 which includes a belt photoconductor (PC) 12 which is rotated around rollers 14–17 in a generally clockwise direction. The photoconductor is charged by corona 18, and an image is placed on the belt 12 by a printer assembly 20 at image station 21. Assembly 20 typically is a laser print head arrangement with appropriate controls for generating discharge images on belt 21, although other devices such as LED arrays, or the like, are also suitable for this purpose.

Photoconductor belt 12 next encounters developer 25 which includes a toner reservoir 26 from which toner is periodically released into the sump of developer 25. A magnetic roller 27 acts as a developer feed roller to a plurality of magnetic brush rollers 28 which engage the developer against the surface of belt 12 as it passes developer 25. An additional discharge corona array 29 discharges the background level of the photoconductor, without significantly affecting the imaged area, prior to introduction of the belt to the transfer station at transfer corona 30. To avoid a separate cleaning station, the magnetic brush rolls 28 are appropriately biased so that they provide both a cleaning and toning function to the photoconductor as it passes developer 25.

Appropriate electronics associated with light source assembly 20 produce the image patterns based upon data received from another device or loaded into printer 10. These images are synchronized with movement of belt 12 so that the image panels appear in the appropriate location. Electronic controls associated with printer 10 monitor the movement of belt 12, such as by emitter monitoring or the like, to ensure appropriate arrival of both the image on belt 12 and copy sheets handled by the upper portion of printer 10 and as described in detail later herein. Print head assembly 20 is conventional as are the controls for assembly 20 and the operation of printer 10.

Upper housing 33 incorporates structure associated with a continuous process duplex system. Broadly, copy sheets in paper drawer 34 are extracted, fed to the transfer station and the fuser, and then introduced to the duplex loop where they are turned over with the leading edge reversed. The sheets are next reintroduced into the copy process with correct timing to copy on the reverse side at the next available machine transfer cycle, followed by delivery to output receptacle 35 which is shown as a receiving bin. Collators, other paper handling devices or stapler/finisher arrangements are suitable for use for output receptacle 35.

Paper drawer 34 provides the input supply source of copy sheets which are fed into aligner 36. They are then moved past the transfer corona 30 and fused by fuser rollers 38 and 39. A gate 40 is positioned to either deflect the copy sheets onto vacuum belt assembly 41 or to direct the sheets into output receptacle 35.

Sheets diverted to vacuum belt transport 41 are carried around the duplex loop and reversed in direction at reverser assembly 42. They are then fed back into aligner 36. After second side transfer and fusing, the sheet with duplex copy is deflected into tray 35.

Figure 2:
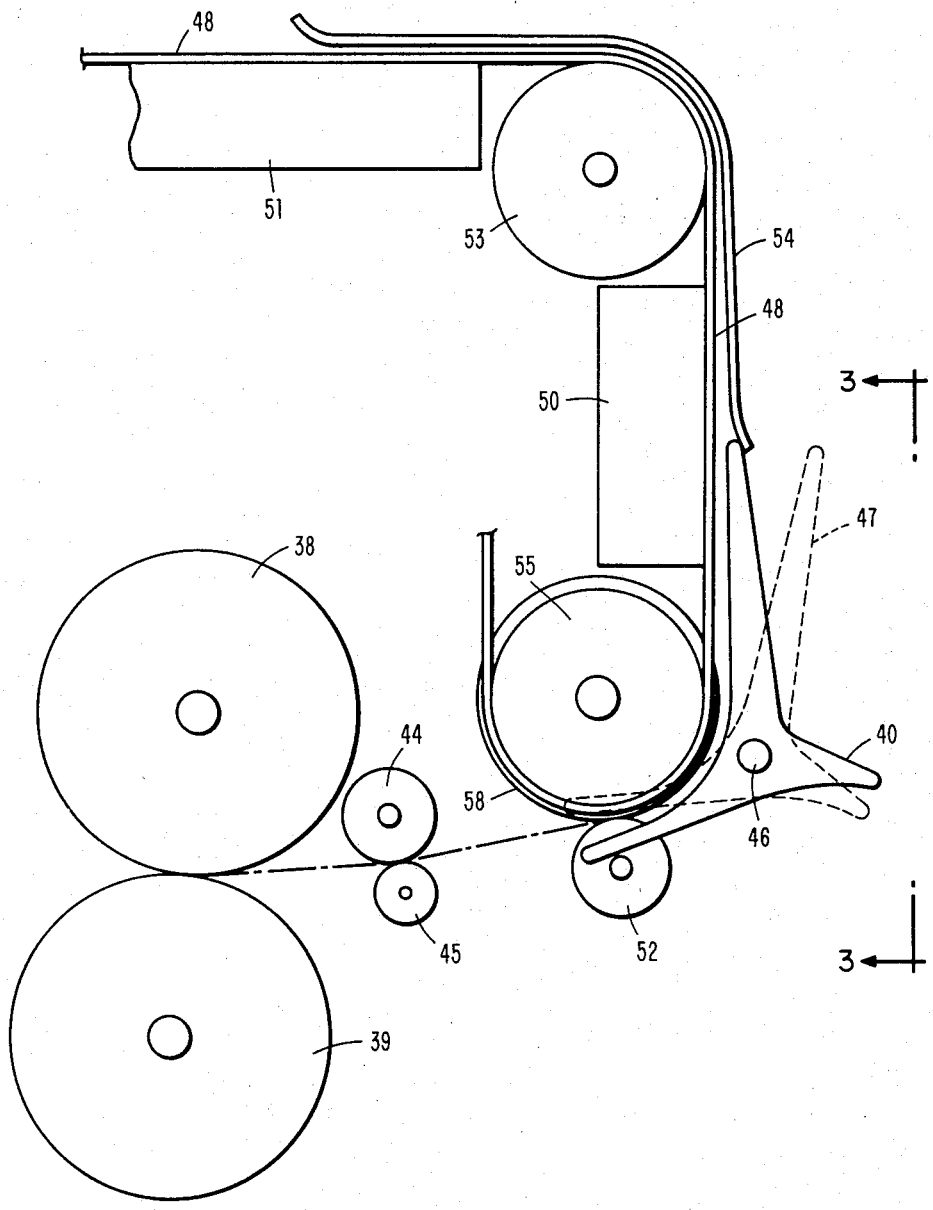
FIG. 2 is a detailed view of the copy sheet paper path arrangement for gating between duplex or exit operations.

The detail of the gating arrangement and vacuum transport pick up is shown in a partially broken view in FIG. 2. Copy sheets leaving the nip of fuser rollers 38 and 39 pass through fuser pinch rollers 44 and 45 before they encounter pivotable deflector 40. Deflector gate 40 is pivoted on shaft 46 into the position shown with solid lines in FIG. 2 to deflect sheets into the duplex loop. Note that deflector gate 40, in the opposite position as shown in the phantom view at 47, provides an exit gating function to deliver the sheets to output receptacle 35.

The vacuum transport assembly 41 composing the main portion of the closed loop duplex paper feed path employs continuous vacuum belts 48 which pass over vacuum plenums 50 and 51. Sheets diverted by gate 40 in the solid position shown in FIG. 2 are thus initially tacked to belt 48 by vacuum plenum 50 and guided around drive roll 53 by guideway 54 where they continue tacked to belt 48 by vacuum plenum 51. That is, the sheets are initially tacked to belt 48 by vacuum plenum 50, although released as they are bent around roller 53, and are retacked to belt 48 as they engage vacuum plenum 51. Guideway 54 is not required if roll 53 is a hollow vacuum roller cooperating with belt 48 to maintain sheet tacking as it passes around the bend.

Figure 3:
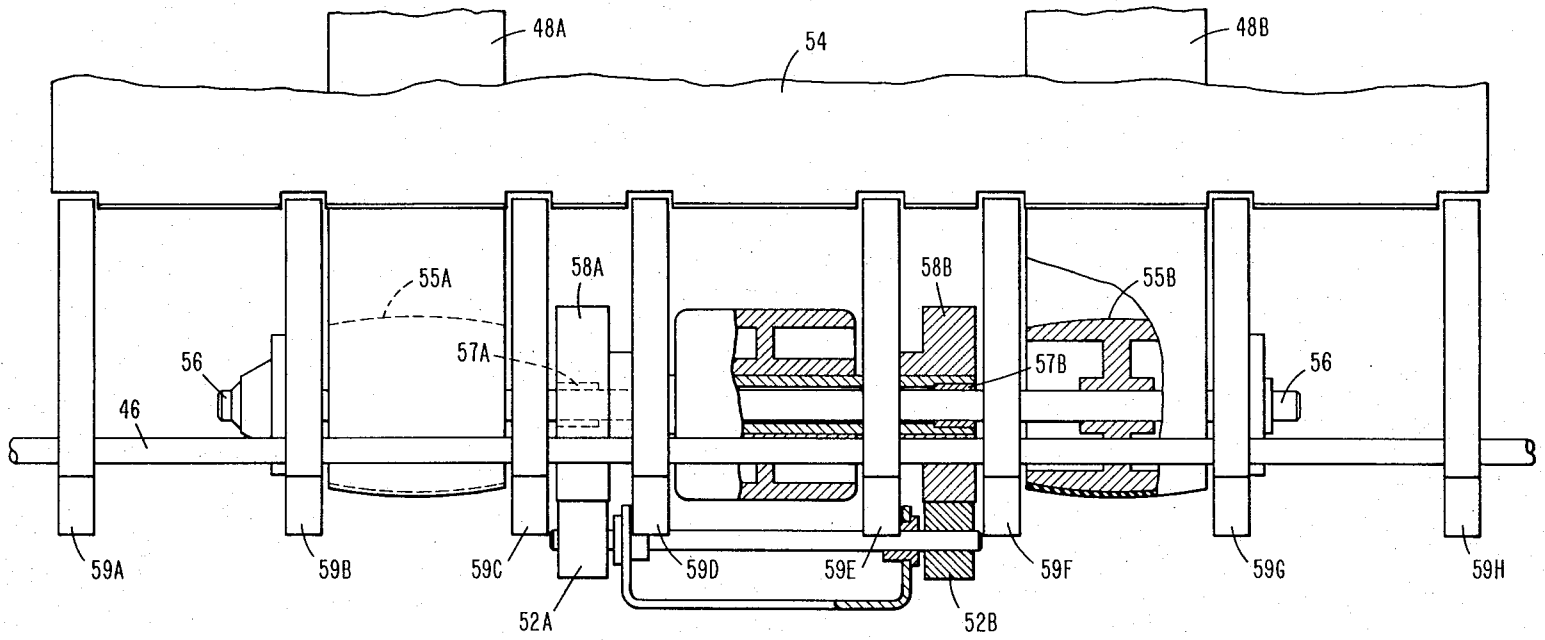
FIG. 3 is a detailed section view of the turnaround rollers associated with FIGS. 1 and 2.

In the sectioned view of the cornering mechanism in FIG. 3, rolls 55A and 55B are driven by vacuum belts 48A and 48B and thus transmit motion to shaft 56. Attached to shaft 56 are arbors (not shown) which drive clutch springs 57A and 57B to transmit torque to rolls 58A and 58B. Clutch springs 57 transmit torque to rolls 58. Springs 57 are positioned so that rolls 58 rotate slower than shaft 56. Since rolls 58 are slightly larger than rolls 55, paper scuffing is minimized.

In operation, the FIG. 3 mechanism accepts sheets exiting from fuser pinch rollers 44 and 45 at a speed of ten inches per second, for example, with the sheets entering duplex rolls 58 which are moving at 33 inches per second, for instance. Springs 57 slip and slow rolls 58 to the fuser velocity but tension the paper. As soon as the sheets exit the fuser, clutch springs 57 accelerate rolls 58, as well as the sheet, to the velocity of shaft 56. Since shaft 56 is driven by vacuum belts 48, the sheet enters the vacuum plenum portion of the duplex path at matched velocity. Note that the deflector gate 40 is composed of a plurality of deflector fingers 59A–59H all mounted on pivotable shaft 46.

Figure 4:
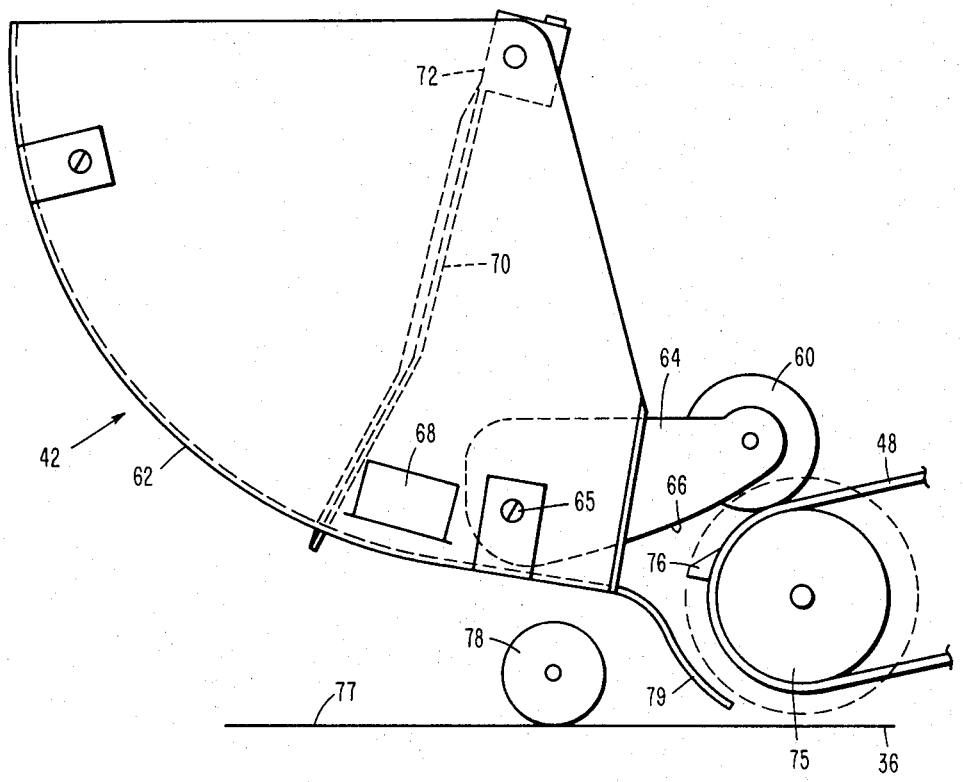
FIG. 4 is a detailed view of the duplex sheet reversal structure associated with the FIG. 1 machine.

FIG. 4 shows the structure associated with the turnaround function applied to the sheet in the duplex return loop. Sheets carried by vacuum belt 48 pass pinch roller 60 and are driven onto turnaround tray 62. Pinch rollers 60 are attached by yoke 64 to pivot shaft 65 and the lower surface 66 provides a deflector function for the sheets as they enter tray 62. The sheets pass discharge corona 68 to remove static charge as they enter tray 62. At the time the sheets enter tray 62, they contact control fingers 70 which are spring loaded at 72 to stop the sheet and hold it against the deflector roll or turnaround roll 75 so that the edge of the sheet is engaged by teeth such as 76 on roll 75. Tooth 76 is one of a plurality of teeth spaced around roll 75 which carry the sheet trailing edge into the aligner area 36 below roll 75. Thus, teeth 76 reverse the direction of the sheet and reintroduce it into the aligner 36.

Note that sheets extracted from supply source bin 34 are driven over paper path 77 and are engaged by drive roller 78 to introduce them into the aligner area 36. A sensor (not shown) detects the movement of the sheet leading edge from tray 62 into the output guide 79 and informs the machine controls of the location of the paper.

Figure 5:
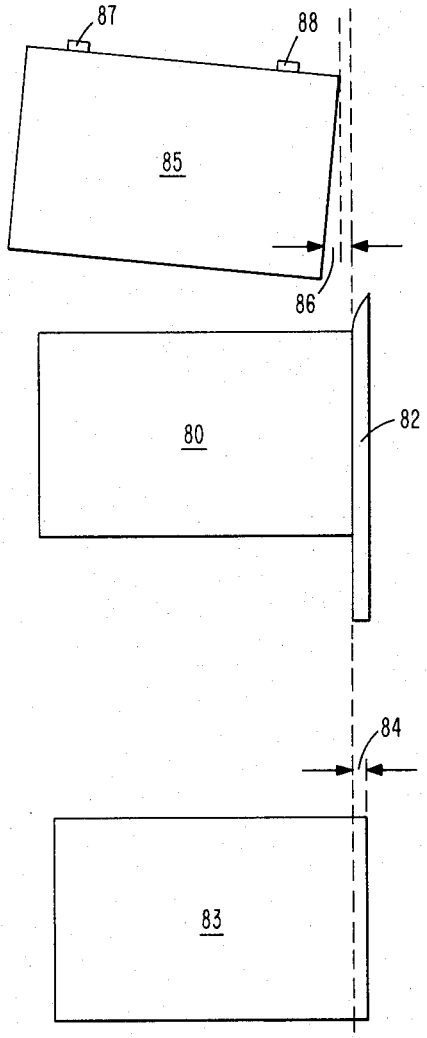
FIG. 5 is an essentially top view illustration of the paper movement as it passes from the duplex tray into the return aligner for duplex copying.

As seen in FIG. 1, the upper plenum of vacuum transport 41 (plenum 51 in FIG. 2) not only transports the sheet but also moves it toward the front of the machine to prevent interference with the aligner. To accomplish this forward movement, the duplex assembly is skewed counterclockwise as viewed from the top in FIG. 1 in relation to the primary paper path 77. FIG. 5 illustrates this dealignment arrangement. Sheet 80 is shown in the primary paper path against the aligner 36 reference edge 82. As the sheet progresses through the paper path, it eventually assumes an orientation as shown at 83 with a drift 84 which can occur during feed. If the sheet is reintroduced into aligner 36 with drift 84, the sheet may interfere with the leading edge of aligner reference edge 82 and jam. To prevent this interference, the duplex assembly is rotated in relation to the primary paper path to pull the edge away from the aligner 36 with this shown as the skew angle 86 associated with sheet 85. By intentionally introducing the skew angle 86, the sheet edge aligns itself with reference edge 82 as it reverses its movement into aligner 36.

Fingers 87 and 88 engage the leading edge of the sheet 85 as it is introduced to tray 62 and are themselves skewed to ensure that the sheet from the vacuum transport 41 approaches aligner 36 on movement reversal in the correct position. As seen in FIGS. 1 and 2, the vacuum at plenum 50 is sufficient to hold the sheet firmly to vacuum belts 48 around guide 53 and until the sheet is firmly held by plenum 51. Since power from vacuum belts 48 drives the system, rolls 55 (FIGS. 2 and 3) and 75 (FIG. 4) are preferably elastomer coated to increase friction against vacuum belts 48.

Figure 6:
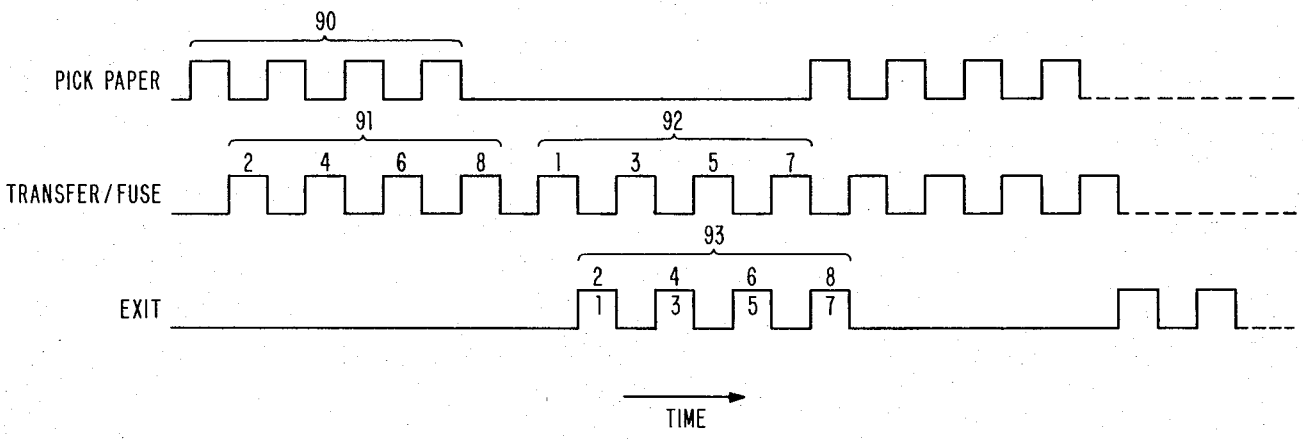
FIG. 6 is a time-based diagram illustrating the maximum transfer cycle duplex operation in accordance with the present invention.

Printer 10 is controlled as a high throughput printer and advantageously cooperates with the machine emitter to utilize every possible transfer cycle, as is illustrated in FIG. 6. In this particular example, it is assumed that the duplex recirculating path is designed to accommodate a maximum of four sheets (sheets A–D in FIG. 1) at any given time. Thus, as shown in FIG. 6, the sheets are picked in groups of four and exit from printer 10 in groups of four. Any sheet is selectable for the first duplex sheet depending on the duplex loop velocity. The transfer points without a sheet feed are the duplex transfers. In the prior art, the first duplex copy is limited to specific points such as the third, fifth or seventh transfer because of the pick cycle. As a result, the duplex loop velocity is very high or very low (a long path with a large buffer or a high-speed marginal reliability paper feed). In the prior art systems, at least two possible transfer cycles are lost, thus decreasing the throughput and the duplex selector vane must operate for every sheet. Using the timing shown in FIG. 6 allows logic changes in machine operation with relative ease during the duplex mode. Some examples are changes in detach pressure, varied vacuum transport pressure and varied aligner plenum pressure. These are changeable for duplexed copies with the FIG. 6 timing because of the grouped processing and allow accommodation of machine parameter control to maximize throughput.

The FIG. 6 chart illustrates continuous copy cycle operation where transfer cycles 1, 2, 3, and 4 are used to transfer images to the sheets as picked. With the continuous cycle duplex, transfer cycles 5, 6, 7, and 8 are used as the first duplex transfers depending on the paper velocity through the duplex loop. Thus, the duplex loop velocity is established for optimum feed reliability.

In FIG. 6, the pulses represented as group 90 correspond to the sequential picking of four sheets of paper from supply source bin 34 in FIG. 1. The transfer/fuse group 91 symbolically illustrates that the sheets sequentially receive the images associated with the second, fourth, sixth, and eighth page of the copy in process. As the sheets are returned to the aligner from the reversing loop of vacuum transport 41 and reverser 42, the first, third, fifth, and seventh images are placed on the sheets in sequence as shown at group 92. Thus, the properly imaged set of sheets is shown as an exiting group at 93 wherein the sheets will have the proper ordered sequence as they fall into output receptacle 35. The machine continues with the next group of four sheets beginning with sheet E (FIG. 1) as shown in FIG. 6. As is also evident in FIG. 6, no transfer/fuse cycle is lost during this operation and the machine operates at its maximum throughput rate.

Those skilled in the art will recognize the physical distance required for sheet feed, alignment, transfer, transport, and fuse. Generally these steps are completed before a sheet is returned for second side or duplex copying. In the present invention, the sheet velocity in a duplex loop to accomplish the timings is selected so that the first sheet is reintroduced to the paper aligner 36 as if it had originated from paper source drawer 34. During the time that the second side copying is underway, no sheets are picked from paper drawer 34. The system as shown and described avoids sheet turning in reversal at high velocity which requires relatively high cost and also acceptance of lower machine operation reliability. By the system as shown and described, paper path direction switching is minimized thus increasing machine reliability.

By the present invention, time for waiting for the first side to cycle through the machine is not wasted and cycling of the duplex/simplex gate 40 is reduced. In addition, the duplex loop velocity is controlled and maintained at a reasonable level and the system has freedom to select which copy is the first duplex copy. The embodiment shown is controllable so that even a run of only a single duplex sheet is processed at a throughput comparable to prior art duplex machines.

Although the present invention is described herein with particularity relative to the foregoing detailed description of an exemplary preferred embodiment, various modifications, changes, additions, and applications of the present invention in addition to those mentioned herein will readily suggest themselves to those having normal skill in the art without departing from the spirit of this invention.

What is claimed is:

1. In a xerographic device having a station for transferring an image to copy sheets sequentially fed from an input supply source and a closed-loop copy sheet paper path for returning copy sheets to said image transferring station with the opposite side presented for imaging, and wherein said device is operable to perform regularly spaced image transfer cycles at said station, the process comprising the steps of:

feeding M out of N copy sheets sequentially from said source past said image transferring station and into said closed-loop path where N is a whole number corresponding to the maximum number of said copy sheets containable in said closed-loop path and M is a whole number equal to or less than N;

transferring a first sequence of M images to a first side of respective said copy sheets during said feeding step;

sequentially reintroducing said M out of N copy sheets to said image transferring station from said closed-loop path with the first said reintroduced sheet arriving at said transfer station concurrent with the commencement of the N+1 image transfer cycle; and transferring a second sequence of M images to the opposite side of respective said copy sheets during said reintroducing step.

2. The process in accordance with claim 1 which includes the steps of:

transferring second side images to the copy sheets during said first sequence transferring steps; and transferring first side images to the copy sheets during said second sequence transferring step.

3. The process in accordance with claim 2 which includes the step of:

delivering the copy sheets to an exit tray after said second sequence transferring step.

4. The process in accordance with claim 1 which includes the step of fusing the image on each copy sheet after it leaves said transferring station.

5. The process in accordance with claim 4 which includes the step of delivering the copy sheets to an exit tray after all images are fused thereon.

6. The process in accordance with claim 1 which includes the steps of:

delivering the copy sheets to an exit tray after said second sequence transferring step; and presenting images during said first and second transferring steps for producing sequentially ordered copy sheet sets in said exit tray.

* * * * *